US010254049B2

(12) United States Patent
Mittelbach et al.

(10) Patent No.: US 10,254,049 B2
(45) Date of Patent: Apr. 9, 2019

(54) METHOD AND APPARATUS FOR EXECUTING AN ALTERNATING EVAPORATION AND CONDENSATION PROCESS OF A WORKING MEDIUM

(75) Inventors: Walter Mittelbach, Freiburg (DE); Ingo Dassler, Halle (DE)

(73) Assignee: SORTECH AG, Halle/Saale (DE)

( * ) Notice: Subject to any disclaimer, the term of this patent is extended or adjusted under 35 U.S.C. 154(b) by 1462 days.

(21) Appl. No.: 14/006,132

(22) PCT Filed: Mar. 21, 2012

(86) PCT No.: PCT/EP2012/054998

§ 371 (c)(1),
(2), (4) Date: Nov. 12, 2013

(87) PCT Pub. No.: WO2012/130689

PCT Pub. Date: Oct. 4, 2012

(65) Prior Publication Data

US 2014/0367071 A1 Dec. 18, 2014

(30) Foreign Application Priority Data

Mar. 25, 2011 (DE) ..... 10 2011 015 153

(51) Int. Cl.
*F28D 15/02* (2006.01)
*F25B 35/04* (2006.01)
(Continued)

(52) U.S. Cl.
CPC ..... *F28D 15/02* (2013.01); *F25B 35/04* (2013.01); *F25B 39/00* (2013.01); *F28D 7/082* (2013.01);
(Continued)

(58) Field of Classification Search
CPC ..... F24F 2003/1458; F24F 2003/1464; F24F 3/147
(Continued)

(56) References Cited

U.S. PATENT DOCUMENTS 3,733,791 A 5/1973 Dravnieks ..... 55/390
4,200,441 A * 4/1980 Honmann et al. .... F24F 3/1423 165/10
(Continued)

FOREIGN PATENT DOCUMENTS

DE 102 32 726 2/2003 ..... F25B 30/04
JP 11-287531 * 10/1999
JP 2005-315465 11/2005 ..... F28F 1/32

OTHER PUBLICATIONS

Maggio G. et al: "A Dynamic Model of Heat and Mass Transfer in a Double-Bed Adsorption Machine with Internal Heat Recovery", International Journal of Refrigeration, Elsevier, Paris, FR, vol. 29, No. 4, Jun. 1, 2006 (Jun. 1, 2006), pp. 589-600, XP027948478, ISSN: 0140-7007 [retrieved on Jun. 1, 2006] the whole document. Abstract and models available at: http://www.sciencedirect.com/science/article/pii/S0140700705001982 (last accessed: Nov. 15, 2013).
(Continued)

*Primary Examiner* — Allen J Flanigan
(74) *Attorney, Agent, or Firm* — Bodner & O'Rourke, LLP; Gerald T. Bodner; Christian P. Bodner

(57) ABSTRACT

The invention relates to a method for executing an alternating evaporation and condensation process of a working medium on a heat transfer surface provided simultaneously as an evaporation and condensation surface. The method is characterized in that, during a respective operating cycle from in each case an condensation process and in each case an evaporation process, a condensate film of the working medium which forms during the condensation process is stored permanently in situ on the heat transfer surface and is
(Continued)

Figure 1:
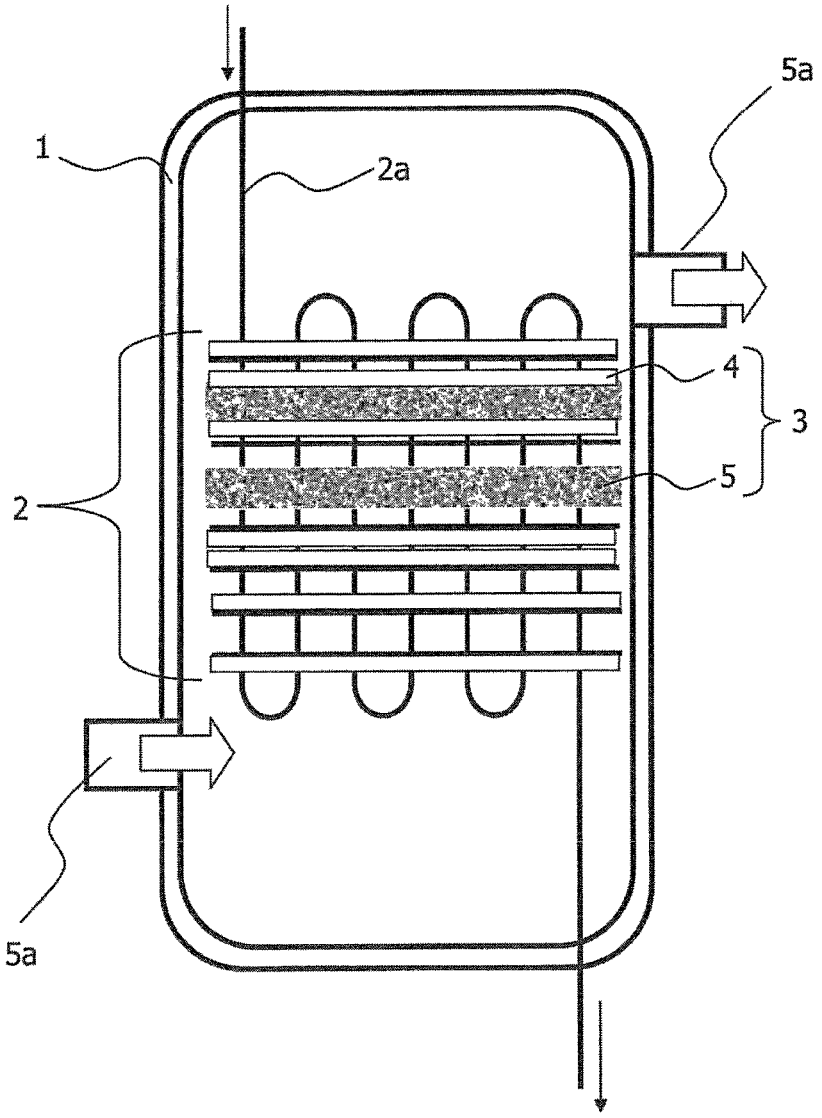

then evaporated from the heat transfer surface during the evaporation process. In terms of the apparatus, the heat transfer surface (2) is in the form of an in-situ store for a condensate film (6) of the working medium which covers the heat transfer surface and does not drip off and remains on the heat transfer surface during the condensation process and evaporates during the evaporation process.

4 Claims, 4 Drawing Sheets

(51) Int. Cl.

| | |
|---|---|
| ***F25B 39/00*** | (2006.01) |
| ***F28F 13/00*** | (2006.01) |
| ***F28F 13/18*** | (2006.01) |
| ***F28D 7/08*** | (2006.01) |
| ***F28F 1/32*** | (2006.01) |
| *F25B 39/02* | (2006.01) |
| *F28D 21/00* | (2006.01) |

(52) U.S. Cl.
CPC ..... *F28F 1/32* (2013.01); *F28F 13/003* (2013.01); *F28F 13/187* (2013.01); *F25B 39/026* (2013.01); *F28D 2021/0066* (2013.01); *F28F 2245/02* (2013.01)

(58) Field of Classification Search
USPC ..... 165/4, 10
See application file for complete search history.

(56) References Cited

U.S. PATENT DOCUMENTS

| | | | | |
|---|---|---|---|---|
| 4,909,307 | A * | 3/1990 | Besik | F24F 3/1411 137/309 |
| 6,039,109 | A * | 3/2000 | Chagnot et al. | F24F 3/1423 165/10 |
| 2005/0167077 | A1* | 8/2005 | Matsugi et al. | F04D 17/105 165/4 |
| 2009/0249825 | A1 | 10/2009 | Olsson et al. | 62/476 |
| 2010/0326628 | A1* | 12/2010 | Campbell et al. | F28D 15/02 165/104.21 |

OTHER PUBLICATIONS

Freni A. et al: "Zeolite Synthesised on Copper Foam for Adsorption Chillers: A Mathematical Model", Microporous and Mesoporous Materials, Elsevier Science Publishing, New York, US, vol. 120, No. 3, Apr. 15, 2009 (Apr. 15, 2009), pp. 402-409, XP025995575, ISSN: 1387-1811, DOI: 10.1016/J.MICROMESO.2008.12.011 [retrieved on Feb. 27, 2009] the whole document. Abstract, models and tables available at: http://www.sciencedirect.com/science/article/pii/S1387181108006380 (last accessed: Nov. 15, 2013).

Freni et al: "An Advanced. Solid Sorption Chiller Using SWS-1L", Applied Thermal Engineering, Pergamon, Oxford, GB, vol. 27, No. 13, May 16, 2007 (May 16, 2007), pp. 2200-2204, XP022081237, ISSN: 1359-4311, DOI: 10.1016/J.APPLTHERMALENG.2005.07.023 the whole document. Abstract and publication available at: http://www.waterandfire.ir/Down_En/7.1_WaterandFire.ir_.pdf (last accessed: Nov. 15, 2013).

The International Preliminary Report on Patentability, in English, dated Oct. 2013, issued from Applicants' corresponding PCT Application No. PCT/EP2012/054998, filed Mar. 21, 2012, from the World Intellectual Property Organization (WIPO) is enclosed.

The Written Opinion of the International Searching Authority, in English, dated Sep. 25, 2013, issued from Applicants' corresponding PCT Application No. PCT/EP2012/054998, filed Mar. 21, 2012, from the World Intellectual Property Organization (WIPO) is enclosed.

The International Search Report, in English, dated Feb. 27, 2013, issued from Applicants' corresponding PCT Application No. PCT/EP2012/054998, filed Mar. 21, 2012, from the World Intellectual Property Organization (WIPO) is enclosed.

The Office Action dated May 21, 2015, in German, issued by the German Patent Office during the prosecution of corresponding German Patent Application No. 102011015153.2.

The Office Action dated Nov. 24, 2015, in Japanese and in English, issued by the Japan Patent Office during the prosecution of corresponding Japanese Patent Application No. 2014-500373.

The Office Action dated Mar. 17, 2015, in Chinese and in English, issued by the China Patent Office during the prosecution of corresponding Chinese Patent Application No. 201280015048.9.

* cited by examiner

METHOD AND APPARATUS FOR EXECUTING AN ALTERNATING EVAPORATION AND CONDENSATION PROCESS OF A WORKING MEDIUM

The invention relates to a method for executing an alternating evaporation and condensation process of a working medium according to the preamble of claim 1, and an apparatus for practicing such a method according to the preamble of claim 5.

Devices of that type are employed, for instance, in the air-conditioning technology, in particular in thermal adsorption heat pumps or refrigerating plants. In plants of this type, a working medium in the form of a refrigerant is cyclically adsorbed and desorbed. In doing so, it is converted from the gaseous phase into the liquid physical condition or from the liquid condition back into the gaseous phase. The condensation heat released on this occasion is dissipated to the outside and needs to be supplied to the device from outside.

It is true that condensation and evaporation are similar in terms of their thermal behavior but require different prerequisites to achieve good heat transfers. These are substantially determined by the transport of heat through the film of the working medium. The thicker the film, the larger the heat transfer resistances that need to be overcome.

In condensers and condensation processes known from the prior art, the forming film is therefore removed from the heat transfer surface by appropriate measures, in particular surface coatings or surface structures. During evaporation, however, a film as thin as possible is attempted to be generated on the heat transfer surface. Such devices are therefore implemented, for example, as falling film evaporators or rotary evaporators, in which the working medium is dispersed as finely as possible.

The removal of the film in the condensation process, on the one hand, and the necessity to form thin film thicknesses of the working medium when evaporating, on the other, prevent that both processes can be executed with a single apparatus, or that one of the two processes within the apparatus is preferential while the other is performed only at a limited efficiency. Combined devices in which both condensation and evaporation are executed, yet are of great interest in particular in adsorption processes such as mainly implemented in heating and refrigerating technology, since they allow compact and cost-efficient thermotechnical appliances, in particular heat pumps or refrigerators to be realized.

It is therefore a task to propose a method for executing an alternating evaporation and condensation process of a working medium on a heat transfer surface provided simultaneously as an evaporation and condensation surface, in which both the condensation process and the evaporation process are executed with the same efficiency. Furthermore, there is the task to create a compact and efficiently working apparatus for alternatingly evaporating and condensing a working medium. The apparatus is intended to be usable in particular in cyclic processes where the working medium is evaporated and condensed in the very same apparatus, and to secure a highest possible effectiveness in both process phases.

The task is solved by means of a method for executing an alternating evaporation and condensation process of a working medium having the characterizing features of claim 1. The dependent claims include purposeful and/or advantageous configurations of the method according to the invention. With respect to the device aspect, the solution of the task ensues by means of an apparatus having the characterizing features of claim 5. The dependent claims likewise include purposeful and/or advantageous embodiments of the apparatus.

The method for executing an alternating evaporation and condensation process of a working medium on a heat transfer surface provided simultaneously as an evaporation and condensation surface is characterized in that, during a respective operating cycle from in each case a condensation process and in each case an evaporation process, a condensate film of the working medium which forms during the condensation process remains permanently on the heat transfer surface and is subsequently evaporated from the heat transfer process during the evaporation process.

Hence, the basic idea of the inventive method is to leave and temporarily store the working medium condensate film that forms during the condensation process on the heat transfer surface. During the evaporation, this condensate film is reconverted into the gaseous phase. Two effects are thereby achieved. On the one hand, the heat transfer during condensation is only performed until the entire condensate film has formed. At this point, the working medium is completely condensed and the condensation comes to its end. The heat transfer from the working medium to the heat transfer surface is thereby affected only to a minor degree since the film has not yet formed completely during the condensation. On the other hand, the storing of the working medium in the form of the condensate film causes quasi automatically the fine and uniform dispersion of the liquid working medium which is advantageous for the evaporation process and needs not even to be generated by additional appliances or methods steps. Altogether, both the condensation process and the evaporation process are thus conducted on the very same heat transfer surface with the same effectiveness and may take place without any intermediate steps.

Appropriately, the ratio between the amount of working medium and the size of the heat transfer surface is at least adjusted such that the thickness of the condensate film remains below a critical film thickness where the condensate film starts dripping off. In such a regime, the entire working medium is condensed and stored in situ on the heat transfer surface. Storing steps and later distributing steps thus are no longer necessary. Collecting means for the condensate are likewise omitted. The heat transfer surface itself acts as a storage site.

In a further embodiment of the method, the ratio between the amount of working medium and the size of the heat transfer surface is adjusted such that an essentially homogenous covering of the heat transfer surface is achieved at a minimum thickness of the condensate film. Such an implementation guarantees an efficiency of the evaporation process as high as possible and at the same time a maximum utilization of the heat transfer surface as an in-situ store for the condensate.

In an advantageous configuration of the method, the covering of the heat transfer surface with the condensate film is achieved by means of a hygroscopic/spreading and/or surface-enlarging formation of the heat transfer surface. The condensate film thereby spreads uniformly, with the surface-enlargement of the heat transfer surface increasing the storage capacity thereof.

An apparatus for executing an alternating evaporation and condensation process of a working medium on a heat transfer surface provided simultaneously as an evaporation and condensation surface is characterized according to the invention in that the heat transfer surface is in the form of an in-situ store for a condensate film of the working medium which remains on the heat transfer surface during the condensation process, and evaporates during the evaporation process, covers the heat transfer surface and does not drip off.

Appropriately, the ratio between the size of the heat transfer surface and the amount of the working medium converted into the condensate film is configured such that the thickness of the condensate film is minimal at an essentially homogenous covering of the heat transfer surface. This enhances in particular the evaporation process efficiency.

In an appropriate embodiment, the heat transfer surface exhibits a surface modification in the form of a hygroscopic surface coating attracting the working medium and/or spreading the working medium. A homogenous and uniform condensate film is thereby achieved.

In an appropriate embodiment, the heat transfer surface exhibits a surface-enlarging formation. The storing capacity of the heat transfer surface is thereby increased. The surface-enlarging formation is realized in an appropriate embodiment as a porous and/or fibrous structure.

Figure 2:
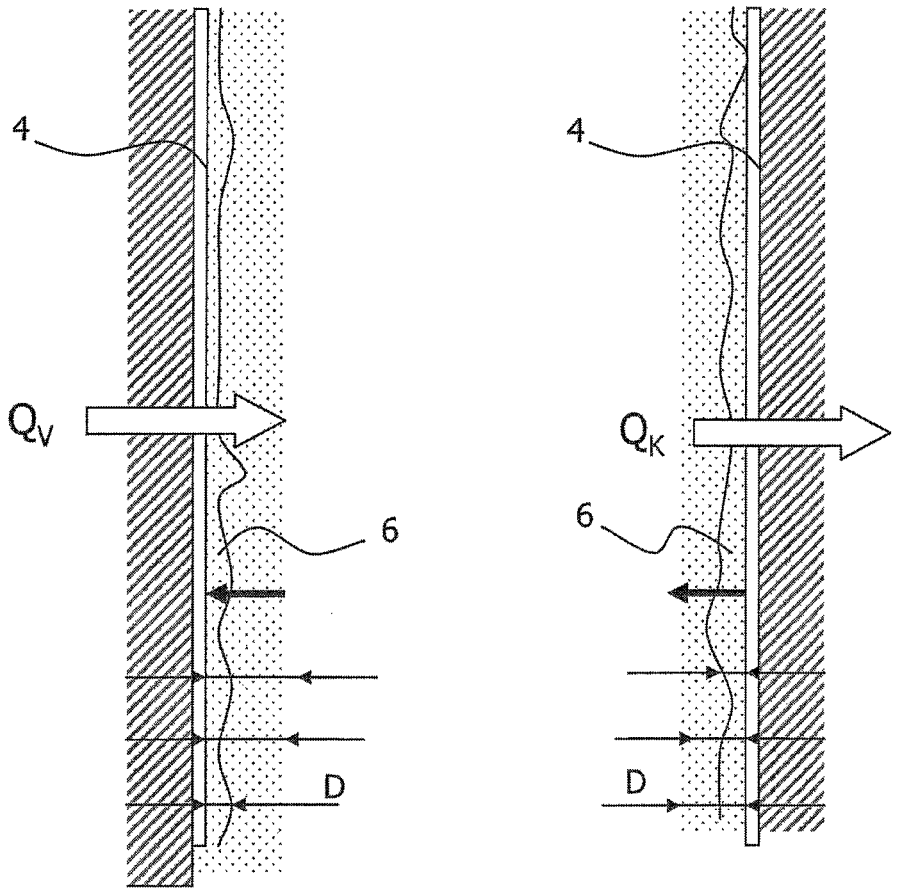
Figure 3:
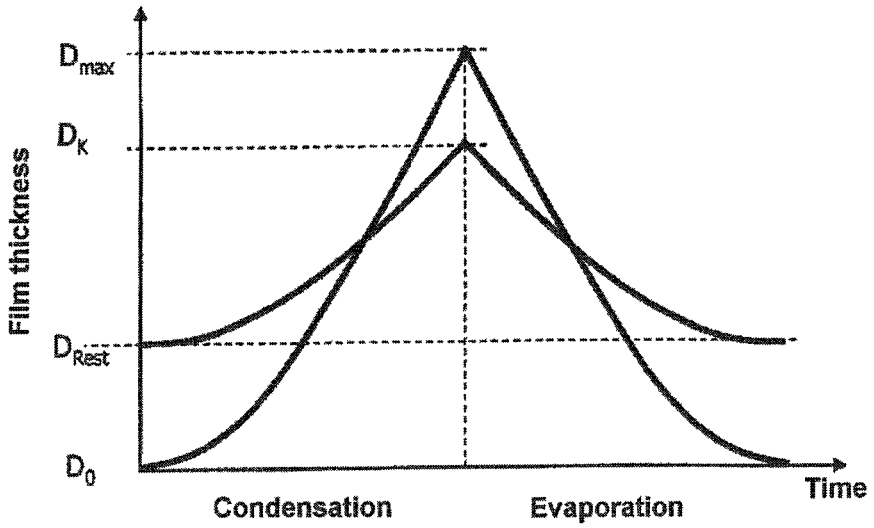

The inventive apparatus and the inventive method will be explained below in more detail on the basis of exemplary embodiments. FIGS. 1 to 3 serve the purpose of clarification. The same reference symbols are used for identical parts or parts of identical action.

Figure 1A:
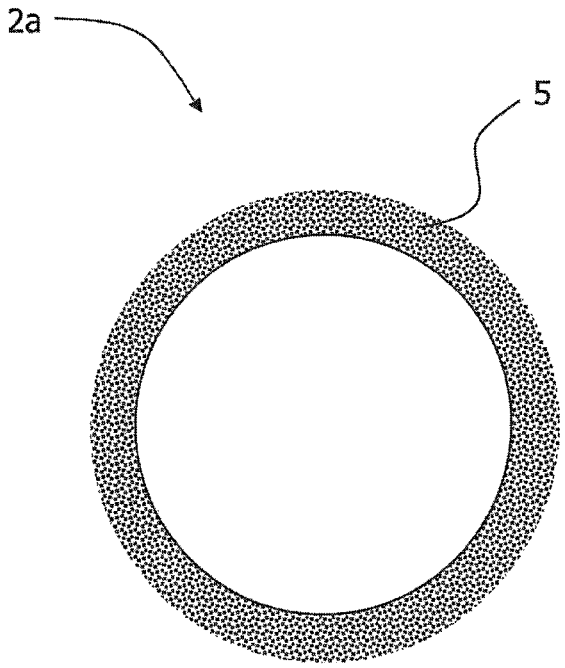

Shown are in:

FIG. 1 a principal configuration of the inventive apparatus,

FIG. 1*a* is an exemplary tube for a heat transfer medium with a porous sheathing, FIG. 2 an illustration of the evaporation and condensation process with a representation of the balanced film, FIG. 3 an exemplary time curve of the film thickness of the condensed working medium during a operating cycle as a function of time.

FIG. 1 shows a principal configuration of the inventive apparatus. The apparatus includes a container wall 1, schematically shown here, which encloses a volume through which the working medium flows. In the interior of the container wall, a multi-segmented heat transfer surface 2 is located which is disposed at a tubing 2*a* laid in a serpentine-like manner. A heat transfer medium dissipating the condensation heat of the working medium or supplying the required evaporation heat to the working medium flows through the tubing 2*a*.

The heat transfer surface is here formed as a unit of single lamellae. The lamellae are oriented such that same can be applied by the working medium as effectively as possible. They form a surface area as large as possible.

The heat transfer surface, i.e. the lamellae used here, each exhibit a surface modification 3. In the present example, the surface modification is formed in different manners. It is, however, clear that in the specific form of the realized embodiment of the apparatus, only one respective preferred and uniform configuration of the surface modification may be present.

The surface modification in the example shown here is comprised of a spreading hydrophilic surface coating 4 and a series of porous filling material or a porous covering 5 applied onto the heat transfer surface 2, i.e. the individual lamellae. In this case, the hydrophilic coating or the porous covering may be provided alone or in combination. The filling materials or the porous covering may be impregnated or at least superficially coated with the material of the surface coating 4. The porous covering exhibits good heat conductivity. It may be implemented, for example, in the form of metal sponges or foams. The use of zeolithe material is likewise possible and very often proves to be advantageous. Instead of sponges or foams, fibrous mats, in particular steel wool or similar materials may also be used. Tube bundles, lattices, granulates, creased foils and similar further means known to the skilled person may also be used for surface-enlargement.

The use of a single porous block which is traversed by the tubing 2*a* and is likewise impregnated or at least superficially provided with a hydrophilic coating is also possible.

The hydrophilic surface coating 4 is formed such that the droplets of the working medium depositing, i.e. condensing thereon spread out into a coherent film which covers the entire heat transfer surface and remains thereon even after completion of the condensation process. In particular hydrophilic materials are used for this purpose which are temperature-resistant, on the one hand, and ensure a contact angle as small as possible, in the ideal case negligible, for deposited condensate droplets.

The porous filling materials ensure an increased inner surface of the apparatus. In conjunction with a hydrophilic loading, these materials act like a sponge and function as a condensate reservoir for the entire amount of the condensed and evaporated working medium.

The shape of the heat transfer surface furthermore is configured such that sharp corners and edges are avoided which could result in the liquid film tearing and dripping off.

FIG. 1*a* is shows an exemplary tubing 2*a*, in which the tube wall itself is formed as a porous covering. Same is, however, tights toward the tube's inner volume so that a mass exchange between the inside and outside does not take place but exclusively a heat transfer. Such a tube may be manufactured by sintering granulates onto a thin-walled initial tube or any other coating method. A hydrophilic coating may of course be provided in addition.

The charging of the apparatus with the working medium is indicated in the FIG. 1 representation by block arrows and lateral inlets and outlets 5*a*. During condensation, the gaseous working medium enters the apparatus and precipitates on the heat transfer surface. On this occasion, the working medium releases condensation heat to the heat transfer surface. After completion of the condensation process, the entire working medium is deposited on the heat transfer surface as a thin condensate film as homogenous as possible. The thickness thereof is adjusted by the amount of the working medium and the size of the heat transfer surface independently of the specifically conducted process regime such that the condensate film does not drip off and remains adhered to the heat transfer surface by adhesion forces. Simultaneously, the condensate film, however, is thin enough to implement the heat input during evaporation as efficiently as possible. The heat transfer surface thus forms an in-situ store for the condensed working medium. This means that the working medium is not transferred to an additional reservoir but is stored just in that place where the respective condensation or evaporation actually takes place.

The flow of the condensation and evaporation process is illustrated in more detail in FIG. 2. FIG. 3 shows the associated time curve of the thickness of the liquid film of the working medium deposited on the heat transfer surface.

The evaporation process is shown on the left in FIG. 2, the condensation process is illustrated by the right partial image in FIG. 2. During the evaporation of the working medium, evaporation heat $Q_V$ is supplied in a sufficient amount from outside via the container wall 1. Same converts at least a part of the amount of the working medium resting on the surface coating 4 into the vapor phase. Normally, the evaporation is executed such that the working medium is completely transferred into the vapor phase from the heat transfer surface.

The condensation process corresponds to a reversal of the evaporation process. The vaporous working medium precipitates from the gaseous phase onto the heat transfer surface and releases the condensation heat $Q_K$ there. On this occasion, the surface film 6 builds up again on the surface coating 4.

FIG. 3 shows the associated time curve of the thickness of the surface film present on the heat transfer surface. The surface film continually grows during the condensation process and finally reaches a maximum film thickness $D_{max}$ of the working medium's condensate film. Upon complete condensation of the working medium on the heat transfer surface, the thickness $D_{max}$ is essentially determined only by the ratio of the working medium's total volume to the size of the available heat transfer surface. With a total volume $V_{ges}$ of the working medium present in the process, and a heat transfer surface with an effective surface area $A_{eff}$, the simple relationship $D_{max}=V_{ges}/A_{eff}$ applies approximately for the thickness $D_{max}$. With the reaching of $D_{max}$, the condensation process reaches an absolute end, and the entire amount of the working medium has now precipitated in the condensate film. The working medium thereafter is completely and in situ stored on the heat transfer surface.

The condensate film is disintegrated in the subsequent evaporation process. The working medium reconverts into the gaseous phase so that the thickness of the surface film decreases to a value $D_0$ after a certain time. With complete evaporation of the working medium, $D_0=0$. The surface film has completely disappeared in this case and the evaporation process reached its absolute end.

If the condensation process and the evaporation process are conducted completely, the liquid film of the working medium deposited on the heat transfer surface fluctuates over time between the values $D_0$ and the maximum film thickness $D_{max}$. Both values thus constitute absolute limit values for the thickness of the stored liquid film which are cyclically reached at different times in the operating cycle.

Since the condensate film reaches its complete thickness $D_{max}$ only at the end of the condensation process, the heat transfer to the heat transfer surface is essentially not inhibited during the condensation process itself. The transfer resistance for the heat transport between the gaseous phase in the container and the heat transfer surface shows to have an essentially identical value during the condensation and evaporation. Consequently, both processes basically proceed with the same efficiency.

The process steps explained above represent a limit process proceeding in the apparatus which exhibits a certain wide control range. Using different kinds of process management, the film thickness achieved during the operating cycles can thus be varied within the given range between $D_0$ and $D_{max}$. In this case, it is in particular possible during the evaporation process to not convert the entire liquid film into the gaseous phase but to design the evaporation process such that a finite residual film thickness $D_{Rest}$ remains on the heat transfer surface. Such a case may occur in particular when the evaporation process ends prematurely.

The condensation process may likewise be conducted such that the maximum film thickness $D_{max}$ does not arise after its completion but an inferior deposition thickness $D_K$. Process regimes of that type offer the opportunity to either compensate for certain fluctuations within the heat loads at a heat contact of the apparatus with the environment or to selectively adjust operating conditions of the thermodynamic process coupled to the apparatus.

The apparatus and the process sequence have been explained in greater detail on the basis of embodiments. Further embodiments are possible within the framework of skilled action. Same will in particular result from the depending claims.

LIST OF REFERENCE SYMBOLS

1 container and device wall
2 heat transfer surface
2*a* tubing
3 surface modification
4 hydrophilic surface modification
5 porous filling materials, porous covering
5*a* inlets and outlets for the working medium
6 surface film
$Q_K$ condensation heat
$Q_V$ evaporation heat
$D_{max}$ maximum film thickness
$D_0$ minimum film thickness
$R_{Rest}$ residual film thickness
$D_K$ deposited film thickness

The invention claimed is:

1. A method for executing an alternating evaporation and condensation process of a working medium on a heat transfer surface provided both as an evaporation and condensation surface in a closed system containing a fixed amount of working medium, characterized in that during a respective operating cycle from in each case a condensation process and in each case an evaporation process, a condensate film of the working medium which forms during the condensation process is stored in situ on the heat transfer surface and is then evaporated from the heat transfer surface during the evaporation process, wherein after the completion of the condensation process, the working medium is deposited on the heat transfer surface as the condensate film, wherein the heat transfer surface is disposed at a tubing having a tube wall, the tube wall having an inner surface and an outer surface, whereby the tube wall itself is formed as a porous covering, and wherein the ratio between the fixed amount of the working medium and the size of the effective surface area of the porous covering of the heat transfer surface is at least adjusted such that the thickness of the condensate film is below a critical film thickness where the condensate film starts dripping off.

2. A method for executing an alternating evaporation and condensation process of a working medium on a heat transfer surface provided both as an evaporation and condensation surface in a closed system containing a fixed amount of working medium, characterized in that during a respective operating cycle from in each case a condensation process and in each case an evaporation process, a condensate film of the working medium which forms during the condensation process is stored in situ on the heat transfer surface and is then evaporated from the heat transfer surface during the evaporation process, wherein after the completion of the condensation process, the working medium is deposited on the heat transfer surface as the condensate film, wherein the heat transfer surface is disposed at a tubing having a tube wall, the tube wall having an inner surface and an outer surface, whereby the tube wall itself is formed as a porous covering, and wherein the ratio between the fixed amount of the working medium and the size of the effective surface area of the porous covering of the heat transfer surface is adjusted such that an essentially homogeneous covering of the heat transfer surface is achieved in this case at a minimum thickness of the condensate film.

3. The method according to claim 1, characterized in that the covering with the condensate film is achieved by a hygroscopic/spreading and/or surface-enlarging configuration of the heat transfer surface.

4. The method according to claim 2, characterized in that the covering with the condensate film is achieved by a hygroscopic/spreading and/or surface-enlarging configuration of the heat transfer surface.

* * * * *